US010570732B2

(12) United States Patent
Lawie et al.

(10) Patent No.: US 10,570,732 B2
(45) Date of Patent: Feb. 25, 2020

(54) SAMPLING AND ANALYSIS SYSTEM AND METHOD FOR USE IN EXPLORATION DRILLING

(71) Applicant: MINEX CRC LTD, Kensington, Western Australia (AU)

(72) Inventors: David Charles Lawie, Woodlands (AU); Anthony Malcolm Stevens, Mullaloo (AU); Frederick Allan Blaine, Doubleview (AU); Michelle Carey, Mount Lawley (AU); Aaron Baensch, Woy Woy Bay (AU); Yulia Uvarova, Munster (AU); James Stuart Cleverley, Glen Forrest (AU); Phillipe Sarrazin, Sunnivale, CA (US)

(73) Assignee: MINEX CRC LTD, Kensington, Western Australia (AU)

( * ) Notice: Subject to any disclaimer, the term of this patent is extended or adjusted under 35 U.S.C. 154(b) by 335 days.

(21) Appl. No.: 15/528,305

(22) PCT Filed: Nov. 19, 2015

(86) PCT No.: PCT/AU2015/000700
§ 371 (c)(1),
(2) Date: May 19, 2017

(87) PCT Pub. No.: WO2016/077869
PCT Pub. Date: May 26, 2016

(65) Prior Publication Data

US 2017/0321546 A1 Nov. 9, 2017

(30) Foreign Application Priority Data

Nov. 19, 2014 (AU) ..... 2014904646

(51) Int. Cl.
*E21B 49/00* (2006.01)
*E21B 47/09* (2012.01)

(52) U.S. Cl.
CPC ..... *E21B 49/005* (2013.01); *E21B 47/09* (2013.01)

(58) Field of Classification Search
CPC ..... E21B 49/005; E21B 47/09
See application file for complete search history.

(56) References Cited

U.S. PATENT DOCUMENTS 2,692,755 A 10/1954 Nowak
5,686,724 A 11/1997 Spilker et al.
(Continued)

FOREIGN PATENT DOCUMENTS

AU 2012318265 A1 6/2013
AU 2013204746 A1 6/2013
(Continued)

OTHER PUBLICATIONS

International Search Report and Written Opinion of the International Searching Authority issued in PCT/AU2015/000700, dated Dec. 11, 2015; ISA/AU.
(Continued)

*Primary Examiner* — Manuel L Barbee
(74) *Attorney, Agent, or Firm* — Stites & Harbison, PLLC; Terry L. Wright

(57) ABSTRACT

A sampling and analysis system, and related method, for use in exploration drilling, particularly diamond drilling. The system includes a number of sub-systems, including a capturing sub-system, a sample recovery and splitting sub-system, a sample preparation/drying sub-system, a sample handling and sensor sub-system, a data collection and management sub-system, an automated data analysis and interpretation sub-system, and a control sub-system for data
(Continued)

collection and process control. The sample handling and sensor sub-system may comprise an integrated arrangement or separate units providing a sample handling sub-system and a sample sensor sub-system. The sample preparation/drying sub-system is operable to ensure that the samples it receives from the sample recovery sub-system are optimally prepared for introduction to the sample handling and sensor sub-system. The sampling and analysis system may be autonomous or operable manually or semi-automatically.

16 Claims, 7 Drawing Sheets

(56) References Cited

U.S. PATENT DOCUMENTS

| | | | | |
|---|---|---|---|---|
| 6,386,026 | B1 | 5/2002 | Zamfes | |
| 8,614,713 | B1 * | 12/2013 | Selman | G01V 1/40 345/440 |
| 2001/0039887 | A1 | 11/2001 | Reddoch | |
| 2003/0037922 | A1 * | 2/2003 | Gibson | B09B 3/0091 166/206 |

FOREIGN PATENT DOCUMENTS

| | | | | |
|---|---|---|---|---|
| WO | WO-1982/002573 | A1 | 8/1982 | |
| WO | WO-8202573 | A1 * | 8/1982 | E21B 23/08 |
| WO | WO-2009101265 | A1 | 8/2009 | |
| WO | WO-2011007053 | A1 | 1/2011 | |
| WO | WO-2013/162400 | A1 | 10/2013 | |
| WO | WO-2013/187904 | A1 | 12/2013 | |

OTHER PUBLICATIONS

Written Opinion of the International Preliminary Examining Authority issued in PCT/AU2015/000700, dated Dec. 7, 2016; IPEA/AU.

International Preliminary Report on Patentability for PCT/AU2015/000700, IPEA/AU, completed Mar. 2, 2017.

Extended European Search Report for Corresponding European Application No. 15861586.4, dated Jun. 14, 2018.

Borde et al, "Chapter 16: Pneumatic and Flash Drying", Jan. 1, 2007 (Jan. 1, 2007), Handbook of Industrial Drying, CRC Press, US, pp. 397-410, XP008161134, ISBN: 978-1-57444-668-5.

European Patent Office, Examination Report issued in corresponding Application No. 15 861 586.4, dated Jun. 7, 2019.

* cited by examiner

SAMPLING AND ANALYSIS SYSTEM AND METHOD FOR USE IN EXPLORATION DRILLING

CROSS-REFERENCE TO RELATED APPLICATIONS

This application is a 371 U.S. National Stage of International Application No. PCT/AU2015/000700, filed Nov. 19, 2015, and published in English as WO 2016/077869 A1 on May 26, 2016, which claims the benefit of and priority to Australian Patent Application No. 2014904646, filed Nov. 19, 2014. The entire disclosures of the above applications are incorporated herein by reference.

FIELD OF THE INVENTION

The present invention relates to sampling and analysis systems and methods for use in exploration drilling.

BACKGROUND ART

The following discussion of the background art is intended to facilitate an understanding of the present invention only. The discussion is not an acknowledgement or admission that any of the material referred to is or was part of the common general knowledge as at the priority date of the application.

In exploration drilling such as mineral exploration drilling, there is a need obtain representative samples for analysis to determine the geology of the earth formation being drilled.

The current practice when performing exploration drilling such as mineral exploration drilling is to send samples obtained during the course of drilling (e.g. core samples obtained from diamond drilling) to a laboratory (which is usually located remotely from the drilling site) for analysis. This usually results in a significant delay between the time that the samples are obtained and the time that the results of the analysis of the samples by the laboratory become available. The delay can be in the order of weeks or months. The delay in obtaining the analysis means that there is minimal, if any, feedback available for use in making decisions while drilling.

In an effort to reduce the aforementioned delay, field-based, semi-mobile laboratories that are situated at or close to the drilling site are sometimes employed. However, such laboratories are very expensive to establish at site, and are usually only used for very advanced exploration projects and during production.

Another option for reducing the delay is to use down-hole geochemical probes, the functionality of which is currently being investigated by various research groups. However, the technology is in its infancy and has not reached the maturity necessary for widespread implementation. Additionally, certain limitations to their use limit the effectiveness and application of geochemical probes.

A further option to reduce the delay is to employ core scanning using X-ray fluorescence (XRF) and/or hyperspectral techniques.

Additionally, there have been proposals to use drilling cuttings as a source of analysis to determine the geology of the earth formation that is being drilled. In this way, the drilling cuttings would constitute a continuous stream of sample material representative of the geological formation being drilled. Such proposals may be implemented by way of in-stream analysers of the type disclosed in International patent publications WO2009101265A1 and WO2011007053A1, and in U.S. Pat. No. 6,386,026.

While the drilling cuttings constitute material representative of the geological formation being drilled, it is necessary that the drilling cuttings be prepared to provide appropriate samples for analysis and to conduct the analysis. This requires that various functions be performed in the field at or in close proximity to the drilling site.

Related to this is the issue that any technique involving (near) real-time, depth integrated geochemical analysis currently used in mineral exploration and resource delineation is limited in its capability by a number of factors, one primarily being that the sample material is presented for testing in a raw form without being properly prepared for presentation in an appropriate condition for testing and analysis. By way of example, the raw sample material is typically a mass of particles of varying grain size, with the mass being wet to varying degrees and unconstrained in form so as to lack uniformity in shape for presentation for testing and analysis. In particular, there is minimal to no sample preparation, no comminution, and no active drying.

As a result of the above factors, the quality of data is sub-standard and cannot reliably be used at the low-level sensitivity required for exploration drilling.

It is against this background, and the problems and disadvantages associated therewith, that the present invention has been developed.

It is an object of the present invention to overcome, or at least ameliorate, one or more of the deficiencies of the prior art mentioned above, or to provide the consumer with a useful or commercial choice.

SUMMARY OF THE INVENTION

According to a first broad aspect of the present invention, there is provided a sampling and analysis system for use in exploration drilling, the system comprising:

means for capturing drilling fluid and cuttings from a drill hole while the hole is being drilled;

means for obtaining a sample of the cuttings from the captured cuttings;

means for drying the sample and for preparing the dried sample such that the sample is able to be presented in manner appropriate for analysis; and means for analysing the sample.

The means for capturing drilling fluid and cuttings may comprise a capturing sub-system.

The means for obtaining a sample of the cuttings may comprise a sample recovery system.

The means for drying the sample and for preparing the dried sample may comprise a sample preparation sub-system for drying the sample.

The means for drying the sample and for preparing the dried sample may comprise a sample handling sub-system for preparing the dried sample.

The means for drying the sample and for preparing the dried sample may comprise a sample preparation sub-system for drying the sample and a sample handling sub-system for preparing the dried sample, with the two sub-systems operating in combination.

The means for analysing the sample may comprise a sensor sub-system.

The sampling and analysis system according to the first broad aspect of the invention may have any one or more of the preferred features as set out below in relation to a sampling and analysis system according to a second broad aspect of the invention.

According to a second broad aspect of the present invention, there is provided a sampling and analysis system for use in exploration drilling, the system comprising:

a capturing sub-system for capturing drilling fluid and cuttings from a drill hole while the hole is being drilled;

a sample recovery sub-system for obtaining a sample of the cuttings from the captured cuttings;

a sample preparation sub-system for drying the sample;

a sample handling sub-system for preparing the dried sample such that the sample is able to be presented in manner appropriate for analysis; and a sensor sub-system for analysing the sample.

Any two or more of the sub-systems may be integrated into a common sub-system. By way of example, the sample handling sub-system and the sensor sub-system may be integrated into a sample handling and sensor sub-system.

The sampling and analysis system according to the invention has been devised particularly, although not necessarily solely, for mineral exploration drilling by way of diamond drilling. However, it should be appreciated that the sampling and analysis system according to the invention may have application to other drilling technologies, including for example reverse-circulation drilling and other drilling techniques operable to produce drilling cuttings as coarse and/or damp material. In the case of reverse-circulation drilling, there would almost certainly be a need for comminution of the drill cuttings so that the cuttings constitute particles which are small enough for the intended analysis which typically needs to be in the low level (ppm) range. In contrast, there would ordinarily be no need for need for comminution of the drill cuttings generated by diamond drilling, as the cuttings are of a sufficiently small granular size to constitute particles appropriate for the intended analysis.

Accordingly, in circumstances where size reduction of at least some of the drill cuttings is required, the sample preparation sub system may further comprise provision for comminution of the drill cuttings. This may be performed separately of, or in conjunction with, drying of the sample.

The drilling fluid may form part of a fluid system, in which the drilling fluid is pumped down the drill string and returns upwardly along an annular space about a drill string, carrying the drilling cuttings. The returning fluid with the entrained drilling cuttings is referred to herein as the drilling fluid returns.

With the sampling and analysis system according to the invention, samples may be taken incrementally by sampling in intervals which represent specific spatial (depth) intervals of the borehole, and then analysed in real time, thereby providing for feedback to be available for use in making decisions while drilling. The sampling intervals may correlate to prescribed volumes of captured drilling cuttings.

If the drilling cuttings are captured continuously during drilling, there is then potential for a correlation between the drill cuttings and the depth within the borehole at which the drilling cutting were generated and retrieved.

Further, if the drilling cuttings are captured continuously in a flow of drilling fluid returns as drilling progresses, and if the sample recovery subsystem provides a stream of recovered drilling cuttings in coordinated sequence with the flow of drilling fluid return, there is then potential for a correlation between the recovered drilling cuttings and the depth within the borehole at which the cutting were generated and retrieved.

Still further, if the captured drilling cuttings are subsequently separated into batches, each in sequence with the stream of recovered drilling cuttings, then each batch would necessarily correspond to a specific depth interval within the borehole. A sample of the recovered drilling cuttings material extracted from any batch of captured drilling cuttings would then be representative of the specific depth interval within the borehole to which the recovered drilling cuttings within the respective batch was related.

Each batch may represent a prescribed volume of captured drilling cuttings. In other words, the captured drilling cuttings are collected by volume, with each volume corresponding to the specific depth interval within the borehole.

In this way, various samples may be obtained, each associated with location information within the borehole as drilling progresses.

In relation to reference to the drilling cuttings being collected continuously during drilling, it will of course be understood by a person skilled in the art that a drilling operation may be conducted sequentially; that is, as a sequence of drilling cycles, with drilling ceasing temporarily between the drilling cycles. Drilling may cease temporarily, for example, to add a drill rod to the drill string or to conduct some other activity related to the drilling procedure. The intervals between drilling cycles may represent the conclusion of one drilling cycle and the commencement of the next drilling cycle. During the interval between one drilling cycle and the next drilling cycle there may be circumstances in which there is no flow of drilling fluid returns.

Each drilling cycle would typically lead to an increase in borehole depth. The duration of each drilling cycle, and the corresponding increase in borehole depth, can vary according to various circumstances, including the geology of the formation being drilled.

In such circumstances, drilling cuttings are collected continuously during each drilling cycle, with the collection ceasing temporarily between drilling cycles While the collection may thus be considered to be intermittent in nature in such circumstances, having regard to the interval between during cycles during which there would be no outflow flow of drilling fluid returns, it is nevertheless continuous in the sense that there is continuity of collection between one drilling cycle and the next. Accordingly, there is continuity of collection of drilling cuttings during drilling.

There are also drilling technologies under development for conducting a drilling operation continuously, rather than drilling being conducted sequentially. With such drilling technologies there is no need for rod changes, thereby permitting continuous drilling. It should be understood that the present invention is applicable to such continuous drilling operations. Indeed, with such continuous drilling operations, the process to establish the correlation between the recovered drilling cuttings and the corresponding depth within the borehole (at which the cutting were generated and retrieved) is likely to be simpler.

It has been found that with the sampling and analysis system according to the invention there is a good correlation between: (i) the findings of analysis of samples derived from drilling cutting for a particular downhole location; and (ii) the findings of analysis of a core sample extracted from that same downhole location.

The sampling and analysis system according to the invention may provide for the collection of high quality, low-level (ppm) multi-element geochemical data, and quantitative minerology as typically required for exploration drilling.

The sampling and analysis system according to the invention may be autonomous in the sense that it is integrated and capable of performing its various functions in a fully automated fashion or at least with a high degree of autonomy. However, this need not be so. The sampling and analysis system need not necessarily be integrated; for example, it may comprise one or more separate units providing one or more of the various sub-systems involved. Further, the sampling and analysis system may be adapted to be operated manually or semi-automatically, at least in part, rather than fully automatically or with a high degree of autonomy.

The drilling fluid returns may be captured in any appropriate way; for example, by collection at the upper end of a drill casing which extends into the borehole and along which the drill string passes, with the annular space around the drill string being defined between the drill string and the surrounding portion of the casing. Typically, the collection is at or in association with a drill collar provided at the upper end of the drill casing. In such an arrangement, the capturing sub-system may comprise a collar capture sub-system for capturing at least a portion of the returning drilling fluid discharging from the borehole.

As drilling progresses, the captured drilling fluid returns may be conveyed continuously to the sample recovery sub-system at which at least some of the drilling cuttings are removed. The removed drilling cuttings can then be used for sampling. In one arrangement, all of the removed drilling cuttings are used for sampling. In another arrangement, only a portion of the removed drilling cuttings are used for sampling. With the latter case, the portion of removed drilling cuttings may be diverted from a stream of recovered drilling cuttings discharging from the sample recovery sub-system. Alternatively, the removed drilling cutting may be collected in batch form and a representative sample of the batch material extracted for analysis.

The sample recovery sub-system may comprise a centrifuge for separating captured drilling fluid and cuttings from each other. The sample recovery sub-system may, for example, comprise part of a solids control system forming part of the fluid system. A solids control system likely to be particularly suitable is of the type disclosed in Australian Patent Applications 2012318265 and 2013204746, the contents of which are incorporated herein by way of reference. With such an arrangement, drilling cuttings removed from the drilling fluid returns by the centrifuge would be discharged as a continuous stream of removed cuttings. The discharging stream could be intercepted and used as a source of drilling cuttings for analysis.

Drilling cuttings removed from the drilling fluid returns are moisture-laden (wet) as a result of the presence of remnant moisture from the drilling fluid.

The sample preparation sub-system may comprise a drying apparatus for drying the sample to remove at least some of the remnant moisture. This is necessary in order to properly prepare the sample for testing and analysis, as excess moisture can be detrimental to the reliability and accuracy of real time analysis. The drying apparatus may comprise a spin flash dryer. A drying apparatus likely to be particularly suitable is of the type disclosed in the applicant's co-pending international application which is entitled "Drying Apparatus and Method" and which claims priority from Australian Provisional Patent Application 2014904649, the contents of both of which are incorporated herein by way of reference.

The sample preparation sub-system may further comprise a discharge outlet for introducing the dried sample to the sample handling sub-system or to the integrated sample handling and sensor sub-system. The outlet may be configured as a hopper.

In case the rate of drilling exceeds the time required for the sensor sub-system, or the integrated sampling handling and sensor sub-system, to analyse the sample, it is preferred that there is provided a buffer for holding the sample. By way of example, the buffer may hold the dried sample prior to introducing the sample to the sensor sub-system or the integrated sampling handling and sensor sub-system. However, the buffer need not necessarily be at that location and may be incorporated into any other appropriate part of the system.

Preferably, the sample preparation sub-system is operable to dry the sample to less than about 1% by weight of water ($H_2O$) without mineralogical damage in less than about 5 minutes.

Preferably, the sample preparation sub-system is adapted such that the dried sample is able to be delivered to the discharge outlet for subsequent delivery to the sample handling sub-system with less than about 1% mass loss.

Preferably, the sample preparation sub-system is adapted to maintain the sample at a temperature of less than about 105° C. to prevent mineralogical damage to the sample.

The prepared sample may be presented for analysis in any appropriate way.

Preferably, the sample handling sub-system is operable to configure the dried sample to present a flat surface to the sensor sub-system for the analysis. The surface is referred to as flat in the sense that is devoid of irregularities which might provide a variation in the distance between the sample and the sensor sub-system to an extent that would compromise the analysis.

Forming the dried sample with a substantially flat surface for presentation to the sensor sub-system for the analysis provides uniformity in presentation of the prepared sample for analysis. This uniformity in presentation is conducive to better and more reliable analysis. If the surface were not leveled, the sample would, in effect, be a slumped pile with an irregular top surface. The irregularity in the top surface would likely not be conducive to reliable analysis.

Preferably, the sample handling sub-system is operable to configure the dried sample to provide a homogenous representation of the sample.

The sample handling sub-system may be operable to compress the dried sample, thereby forming the required flat surface for presentation to the sensor sub-system for the analysis and also compacting the dried sample to provide the required homogeneous representation of the sample to an appropriate depth without voids. Compaction of the dried sample in a zone adjacent the surface thereof intended for presentation to the sensor sub-system for the analysis may also be beneficial in the subsequent analysis of the prepared sample. This is because the particles in the compacted zone adjacent the surface are presented in a more dense condition, which has the beneficial effect of exposing more of the particles to analysis.

In one arrangement, the sample handling sub-system may present the dried sample for analysis in a confined condition in open-topped container. The sample within the container may be compressed to present the sample in a condition featuring a flat top surface and also a compacted condition to provide a homogeneous representation of the sample. The sample container may comprise a sample pot. The sample within the container may be compressed in any appropriate way, such as for example by high pressure hydraulic or pneumatic compression on the sample material.

In another arrangement, the sample handling sub-system may present the dried sample for analysis in a confined condition as a pressed pellet. The pressed pellet may be formed in any appropriate way, such as introducing the prepared sample material in powder form into a die and then pressing the sample material to produce a homogeneous sample pellet. The sample pellet so produced also features a flat surface for presentation to the sensor sub-system for the analysis.

It may also be beneficial for specific analysis types to present the sample in another form, for example a free flowing powder. The sample preparation system can have a plurality of sample streams, each prepared in the appropriate manner for a given analysis.

There may be one or more sensor sub-systems. The sensor sub-system, or each sensor sub-system, may be of any appropriate form. This may include, but without being limited to, any of the following: an X-ray fluorescence (XRF) sensor sub-system; an X-ray diffraction (XRD) sensor sub-system; an infra-red (IR) spectroscopy sensor sub-system; a near infra-red (NIR) spectroscopy sensor sub-system; a shortwave infra-red (SWIR) spectroscopy sensor sub-system; a laser-induced breakdown spectroscopy (LIBS) sensor sub-system; a Gamma logging sensor sub-system; a magnetic susceptibility sensor sub-system; and a Raman spectroscopy sensor sub-system.

The sampling and analysis system may also comprise a data collection and management sub-system for collecting and managing field operation data and data obtained from the sensor sub-systems of the sample handling and sensor sub-system. Preferably, the field operation data may comprise data of any required form as appropriate including, for example data relating to the following: event data; rate of penetration (ROP); and drilling state data.

Preferably, the field operation data is time-stamped.

Preferably, the data collection and management sub-system transfers the data to cloud-based data storage.

Preferably, the data collection and management sub-system aggregates analytical data with associated metadata.

The sampling and analysis system may also comprise an automated data analysis and interpretation sub-system for processing data from the data collection and management sub-system.

Preferably, the automated data analysis and interpretation sub-system is able to process at least some of the data using a depth positioning algorithm.

Preferably, the automated data analysis and interpretation sub-system is able to process data from the sensor sub-systems of the sample handling and sensor sub-system.

Preferably, the automated data analysis and interpretation sub-system is able to provide decision support in relation to the continued drilling of the hole and the planning of subsequent holes.

Preferably, the automated sampling and analysis system also comprises a control sub-system for controlling the automated sampling and analysis system.

According to a third broad aspect of the present invention, there is provided a sampling and analysis method performed using a sampling and analysis system according to the first or second broad aspect of the invention.

According to a fourth broad aspect of the present invention, there is provided a sampling and analysis method for use in exploration drilling, the method comprising the steps of:

capturing drilling fluid and cuttings from a drill hole while the hole is being drilled;

obtaining a sample of the cuttings from the captured cuttings;

drying the sample;

preparing the dried sample such that the sample is able to be presented in a manner appropriate for analysis; and analysing the prepared sample.

In preparing the dried sample such that the sample is able to be presented in a manner appropriate for analysis, the dried sample is preferably so prepared that is able to be presented in an optimised manner for analysis.

Preferably, the step of capturing drilling fluid and cuttings comprises capturing the drilling fluid and cuttings at a drilling rig. This may be way of a collar capture sub-system fitted on or associated with the drilling rig.

Preferably, the step of obtaining a sample of the cuttings comprises separating the captured drilling fluid and cuttings from each other. It is preferred that the captured drilling fluid and cuttings are separated from each other by way of a centrifugal action performed, for example, by a centrifuge.

Preferably, the step of drying the sample comprises drying the sample with a spin flash dryer. The dried sample may be delivered to a discharge outlet such as a hopper.

The method may further comprise holding the sample in a buffer. By way of example, the dried sample may be held in a buffer prior to being prepared for analysis. In one arrangement, the dried sample may be held in a buffer prior to delivery to hopper discharge outlet.

Preferably, the step of preparing the dried sample comprises configuring the sample to present a flat surface for the analysis. This may comprise forming the sample with a substantially flat surface.

Preferably, the step of preparing the dried sample comprises configuring the sample to provide a homogenous representation of the sample.

The step of preparing the dried sample may comprise compressing the sample, thereby forming the required flat surface for presentation for the analysis and also compacting the sample to provide the required homogeneous representation of the sample.

In one embodiment, the step of preparing the dried sample may comprise confining the dried sample material in an open-topped container. This step may further comprise compressing the sample material within the container to present the sample in a condition featuring a flat top surface and also a compacted condition to provide a homogeneous representation of the sample.

In another embodiment, the step of preparing the dried sample may comprise forming the sample material into a pressed pellet. This may comprise introducing the dried sample material in powder form into a die and then pressing the sample material to produce a homogeneous sample pellet.

Preferably, the step of analysing the prepared sample comprises analysing the prepared sample using at least one analysis method. Preferably, each at least one analysis method is selected from a group of analysis methods comprising: X-ray fluorescence (XRF) analysis; X-ray diffraction (XRD) analysis; infra-red (IR) spectroscopy analysis; near infra-red (NIR) spectroscopy analysis; shortwave infra-red (SWIR) spectroscopy analysis; laser-induced breakdown spectroscopy (LIBS) analysis; Gamma logging analysis; magnetic susceptibility analysis; and Raman spectroscopy analysis.

Preferably, the sampling and analysis method also comprises the step of collecting and managing field operation data and data obtained from analysing the prepared sample. Preferably, the field operation data comprises data selected from a group of data comprising: event; rate of penetration (ROP); and drilling state data. Preferably, the field operation data is time-stamped. Preferably, the step of collecting and managing field operation data and data obtained from analysing the prepared sample comprises transferring the data to cloud-based data storage.

Preferably, the sampling and analysis method also comprises the step of processing the data. Preferably, the step of processing the data comprises processing at least some of the data using a depth positioning algorithm. Preferably, the step of processing the data comprises processing at least some of the data obtained from analysing the prepared sample. Preferably, the step of processing the data comprises providing decision support in relation to the continued drilling of the hole and the planning of subsequent holes.

BRIEF DESCRIPTION OF THE DRAWINGS

In order that the invention may be more fully understood and put into practice, several preferred embodiments thereof will now be described with reference to the accompanying drawings, in which.

In the drawings like structures are referred to by like numerals throughout the several views. The drawings shown are not necessarily to scale, with emphasis instead generally being placed upon illustrating the principles of the present invention.

Figure 1:
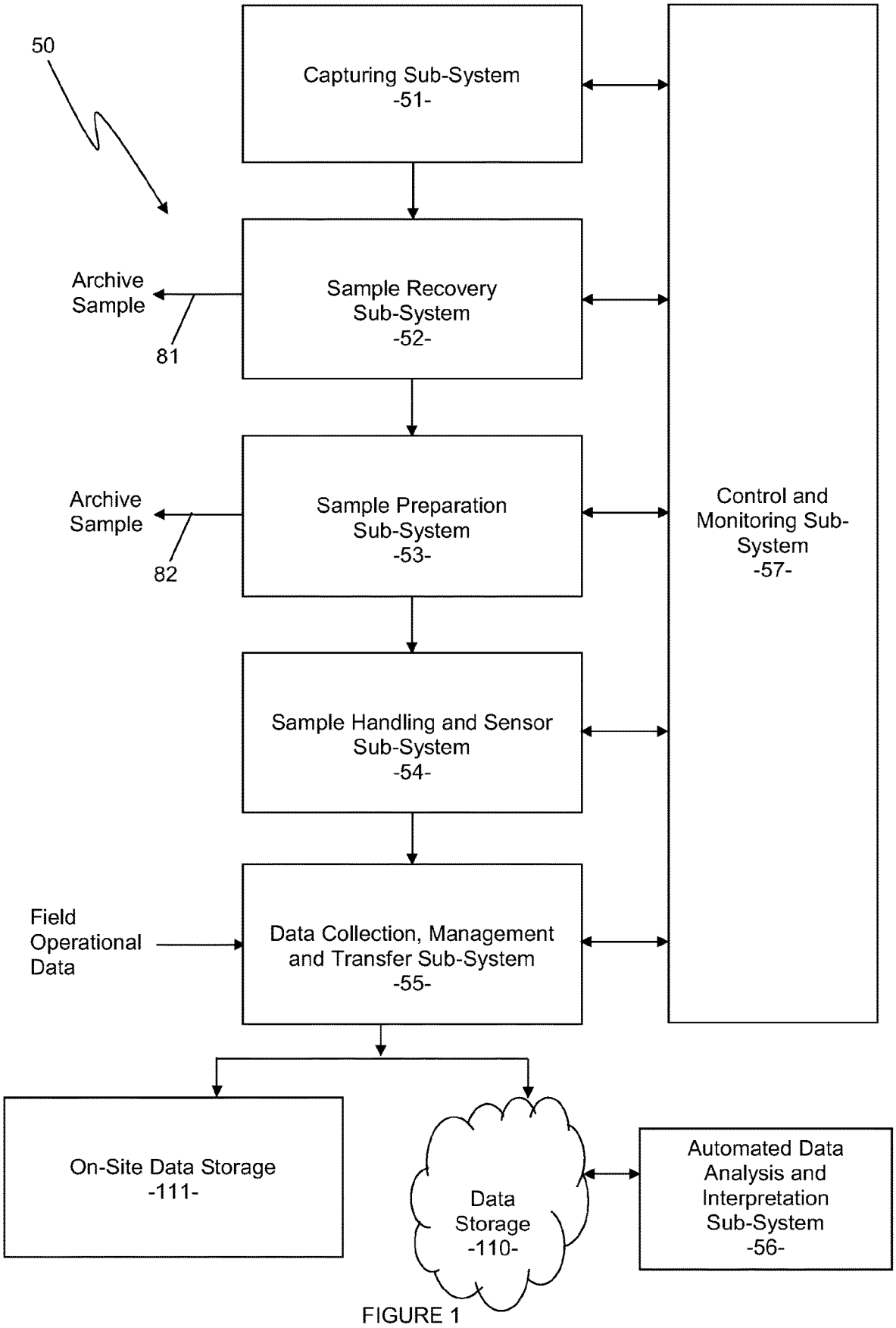
FIG. 1 is a schematic diagram of a first preferred embodiment of sampling and analysis system for use in exploration drilling.

The figures which constitute the drawings depict exemplary embodiments of the invention. The embodiments illustrates certain configurations; however, it is to be appreciated that the invention can take the form of many configurations, as would be obvious to a person skilled in the art, whilst still embodying the present invention. These configurations are to be considered within the scope of this invention.

DESCRIPTION OF EMBODIMENTS

In the drawings, like features have been referenced with like reference numbers.

Referring to FIG. 1, there is depicted a schematic diagram of a first embodiment of a sampling and analysis system 50 for use in exploration drilling. In this first embodiment, the system 50 is an autonomous, integrated sample collection and preparation, ppm-level geochemical analysis, semi-quantitative mineralogical analysis, data management and data interpretation system. It is able to collect and interpret depth integrated (near) real-time down-hole geological data for use in diamond-drilling applications. It is also able to provide an optimum sample of geological material obtained from diamond drilling for analysis by providing sample drying and presentation of the sample in an optimised manner.

With application to diamond drill holes (DDH), the system 50 caters for holes that are drilled to any depth, including for example to a depth 1 km and more. The system 50 is able to maintain the chain of custody of a drilling sample throughout the process of obtaining and analysing the sample. The system 50 captures all drilling fluid and cuttings at the collar of a drill hole. The system 50 is able to manage the material obtained from the drill hole through a centrifuge. The centrifuge may comprise part of a solids control system forming part of a fluid system, in which drilling fluid is pumped down a drill string and returns upwardly along an annular space about the drill string, carrying the drilling cuttings. A solids control system likely to be particularly suitable is of the type disclosed in Australian Patent Applications 2012318265 and 2013204746, the contents of which are incorporated herein by way of reference. The system 50 is able to capture all centrifuge waste or a representative sub-sample of the output of the centrifuge so as to produce a high quality representative fine-grained sub-sample. The system 50 archives a portion of the sample material for subsequent analysis, and provides a sample of the material for analysis. The archived portion may, for example, comprise an amount of 150 g.

The system 50 splits, conditions, transports and presents the sample to various analysing sensors in a manner optimised for analysis by each analysing sensor by using multiple sample streams.

The system 50 analyses the sample using X-ray fluorescence (XRF) and X-ray diffraction (XRD), and/or other analytical techniques such as, for example, near infra-red (NIR) spectroscopy, shortwave infra-red (SWIR) spectroscopy, laser-induced breakdown spectroscopy (LIBS), Gamma logging, magnetic susceptibility, Raman, etc., to produce fit for purpose data. The system 50 transmits data, including analytical spectra and results to cloud-based data management systems. The system 50 provides (near) real-time access to data and knowledge derived through advanced processing of the data via web-based, software as a service (SAAS) technology.

In order to achieve the above, the system 50 includes a number of sub-systems (as shown schematically in FIG. 1), including a capturing sub-system 51, a sample recovery and splitting sub-system 52, a sample preparation/drying sub-system (SPS) 53, a sample handling and sensor sub-system (SHSS) 54, a data collection, management and transfer sub-system 55 (provided by a data HUB), an automated data analysis and interpretation sub-system 56, and a control and monitoring sub-system 57 for data collection and process control. In this embodiment, the sample handling and sensor sub-system 54 comprises an integrated arrangement featuring a sample handling sub-system and a sample sensor sub-system. It should, however be appreciated that the sample handling sub-system and a sample sensor sub-system need not necessarily be integrated into the sample handling and sensor sub-system 54, and that they may instead comprises separate units; that is one unit providing a sample handling sub-system and a separate unit providing a sample sensor sub-system.

Figure 2:
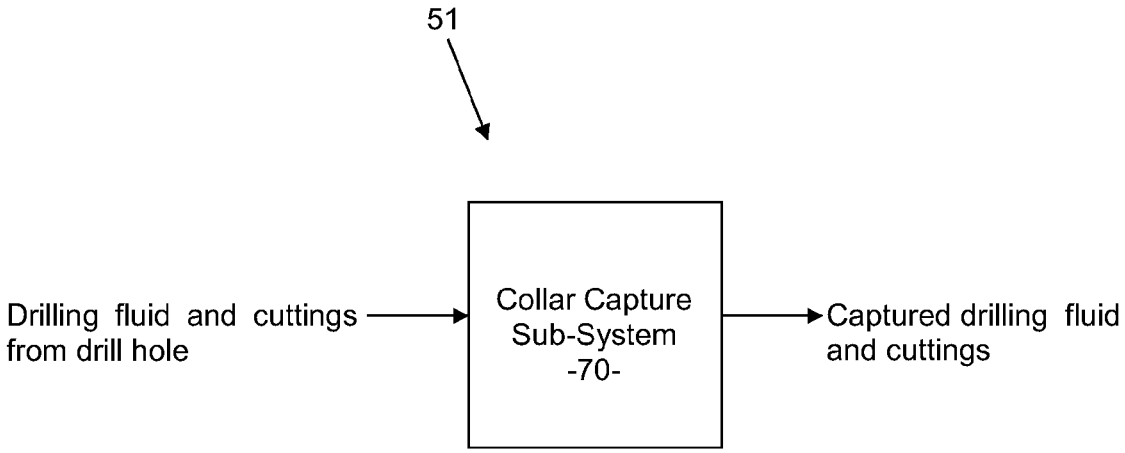
FIG. 2 is a schematic diagram of a collar capture sub-system of the system depicted in FIG. 1.
Figure 3:
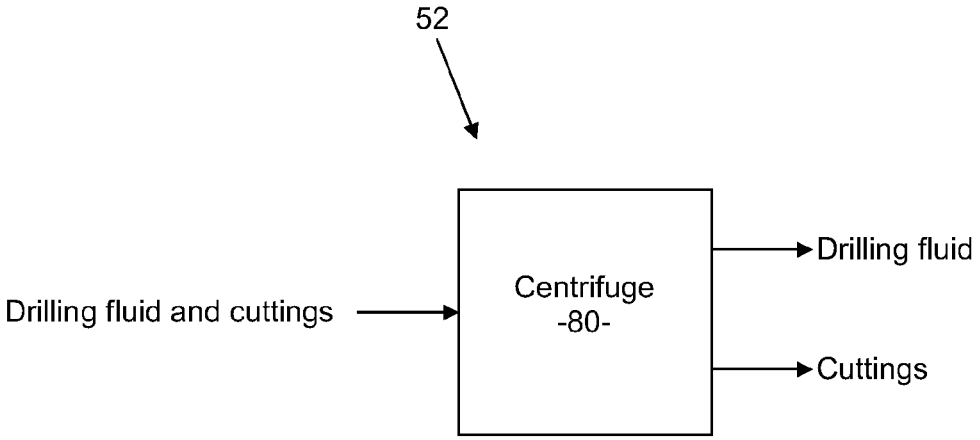
FIG. 3 is a schematic diagram of a centrifuge of the system depicted in FIG. 1.

Referring to FIG. 2, the capturing sub-system 51 comprises a collar capture sub-system 70, the purpose of which is to capture returning drilling fluids which have been cycled through the drill string of the drilled hole being sampled and analysed. The collar capture sub-system 70 maintains the drilling cuttings, which comprise particulate material generated through drilling, in suspension within the fluid and directs the fluid to the sample recovery system 52 which, as mentioned above, includes a centrifuge. The collar capture sub-system 70 captures the returning drilling fluids continuously as drilling progresses and conveys the drilling fluid returns in a continuous stream to the sample recovery system 52

It is a feature of diamond drilling that no comminution of the drilling cuttings is required. As the drilling cuttings comprise particulate material generated through drilling, they are inherently of sufficiently small size appropriate for preparation of the sample for testing and analysis.

The purpose of the sample recovery sub-system 52 is to remove the drill cuttings (i.e. the sample) from the drilling fluids and to make the sample available, at a reduced moisture content amenable to subsequent rapid drying within the sample preparation sub-system 53.

The sample recovery sub-system 52 is able to recover solid material down to a grain size of 5 microns or less from the captured drilling fluids, while maintaining the time sequence of material flow. As mentioned above, the sample recovery sub-system 52 includes a centrifuge 80 which enables removal of solids in a time linear fashion. The sample recovery sub-system 52 is able to maintain chain of custody throughout this process. It is able to provide continuous recovery of sequential sub-samples representative of the adjustable user defined intervals (consistent with decimeter retained fidelity) that will be dried and then used in the analysis.

Based on test work performed to-date, the recovered material is <38 μm at an exceedance probability of P90.

In a typical diamond drilling scenario, the amount of material recovered is typically approximately 7-8 kg in weight for every metre of drilling using NQ. This would, of course, change using different drilling bit diameters.

In this embodiment, the sample recovery sub-system 52 may comprise part of a solids control system of the type disclosed in Australian Patent Applications 2012318265 and 2013204746. Such solids control system includes centrifuge 80. With such an arrangement, drilling cuttings removed from the drilling fluid returns by the centrifuge 80 would be discharged as a continuous stream of removed cuttings. The discharging stream could be intercepted and used as a source of drilling cuttings for analysis.

As shown in FIG. 1, the archive sample mentioned earlier (the mass of which is user-defined) is taken from the main stream of material either at the sample recovery stage (as shown by the arrow 81) while the material is wet, or after the drying stage performed by the sample preparation sub-system 53 (as shown by the arrow 82).

The sample recovery sub-system 52 delivers the sub-samples to the sample preparation sub-system 53.

The purpose of the sample preparation/drying sub-system 53 is to ensure that the samples it receives from the sample recovery sub-system 52 are optimally prepared for introduction to the sample handling and sensor sub-system 54. The primary requirements of the sample preparation sub-system 53 are drying and disagglomeration of the sampled cuttings produced by drilling a diamond drill hole (DDH).

Figure 4:
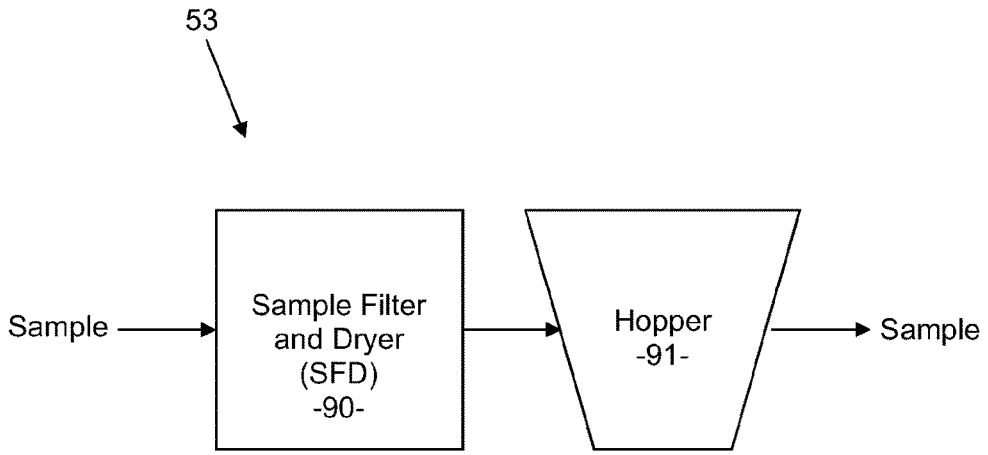
FIG. 4 is a schematic diagram of the sample preparation sub-system of the system depicted in FIG. 1.

Referring to FIG. 4, the sample preparation sub-system 53 includes a drying apparatus which is this embodiment comprises a spin flash dryer (SFD) 90. Other forms of drying apparatus may, of course, be used, including for example a drying oven. However, a spin flash dryer is particularly advantageous, as the rate at which it can dry sample material is conducive to in-stream or autonomous operation of the system 50. A spin flash dryer likely to be particularly suitable is of the type disclosed in the applicant's co-pending international application which is entitled "Drying Apparatus and Method" and which claims priority from Australian Provisional Patent Application 2014904649.

The spin flash dryer 90 is able to dry a representative sub-sample to less than 1% by weight of water ($H_2O$) without mineralogical damage in less than 5 minutes. It is also able to deliver the dried sample to a hopper 91, which is also part of the sample preparation sub-system 53, for introduction to the sample handling and sensor sub-system 54 with less than 1% mass loss. The sample preparation sub-system 53 prevents mineralogical damage to the sample by maintaining the temperature of the sample at less than 105° C.

Figure 5:
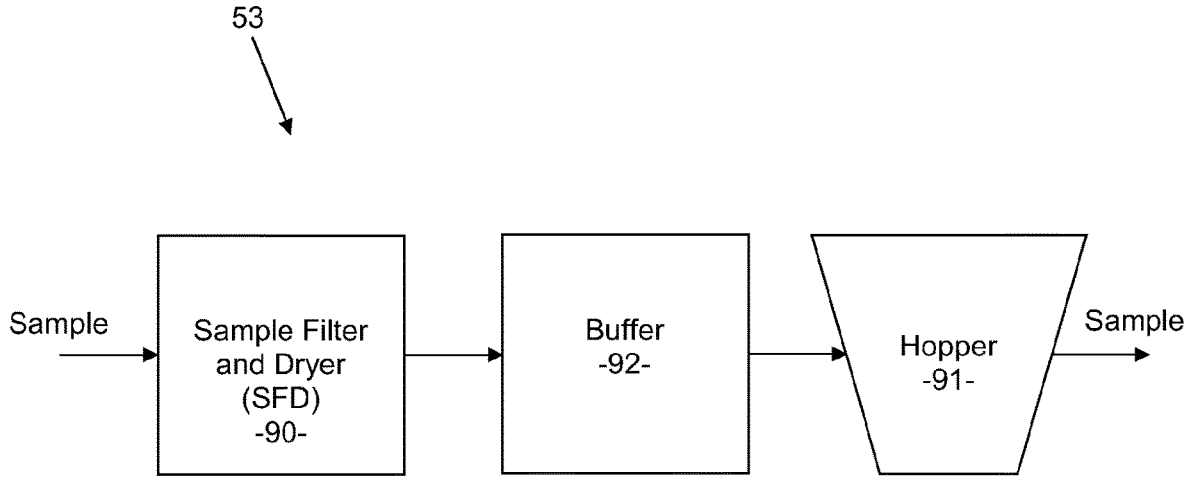
FIG. 5 is a schematic diagram of the sample preparation sub-system when it includes a buffer.

Referring to FIG. 5, where drilling rates are in excess of the time required to analyse samples, the sample preparation sub-system 53 can also include a buffer 92 to hold dried samples prior to the dried sample being delivered to the hopper 91 for introduction to the sample handling and sensor sub-system 54.

Figure 6:
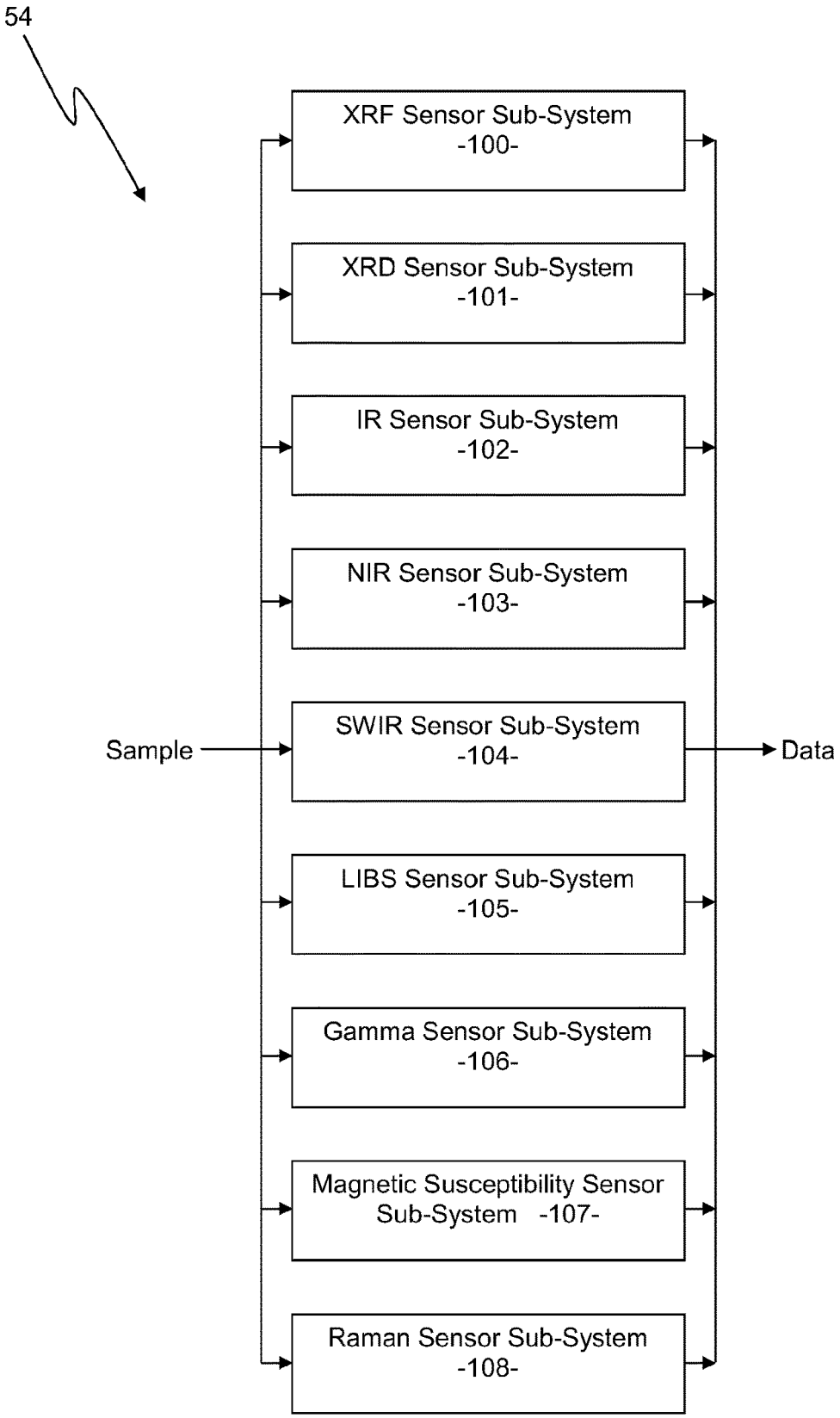
FIG. 6 is a schematic diagram of the sample handling and sensor sub-system of the system depicted in FIG. 1.

Referring to FIG. 6, the purpose of the sample handling and sensor sub-system 54 is to prepare the dry free-flowing powder for analysis and to present it to its sensor sub-systems in an optimised and quality assured manner.

The sample preparation sub-system 53 for drying the sample, and the sample handling sub-system for preparing the dried sample (being part of the sample handling and sensor sub-system 54), cooperate to provide a means for drying the sample and for preparing the dried sample such that the sample is able to be presented in manner appropriate for analysis.

The sample handling and sensor sub-system 54 operable to configure the dried sample material to provide a sample which presents a flat surface for the analysis. The surface is referred to as flat in the sense that is devoid of irregularities which might provide a variation in the distance between the sample and the sensor sub-system to an extent that would compromise the analysis.

The sample handling and sensor sub-system 54 is operable to also configure the dried sample material to provide a homogenous representation of the sample.

In one arrangement, the sample handling and sensor sub-system 54 may present the prepared sample material for analysis in an open-topped container. The sample material within the container may be compressed to present the sample material with a flat top surface and also in a compacted condition to provide a homogeneous representation of the sample. The sample container may comprise a sample pot. With this arrangement, a carrier mechanism (not shown), such as an endless belt conveyor, may be provided for advancing the sample container, along with other similar containers in series, through the sample handling and sensor sub-system 54.

In another arrangement, the sample handling and sensor sub-system 54 may present the prepared sample for analysis as a pressed pellet. The pressed pellet may be formed by introducing the prepared sample material in powder form into a die and then pressing the sample material to produce a homogeneous sample pellet. The sample pellet so produced also features a flat surface for presentation to the sensor sub-system for the analysis.

Forming the sample with a substantially flat surface for presentation to the sensor sub-system for the analysis provides uniformity in presentation of the prepared sample for subsequent analysis.

The sample handling and sensor sub-system 54 further comprises an X-ray fluorescence (XRF) sensor sub-system 100 for defining accepted detection limits, and an X-ray diffraction (XRD) sensor sub-system 101. The XRF and XRD sensor sub-systems 100, 101 comprise primary sensor sub-systems of the sample handling and sensor sub-system 54.

The sample handling and sensor sub-system 54 can include additional sensor sub-systems. For example, possible additional sensor sub-systems include, but are not limited to: an infra-red (IR) sensor sub-system 102; a near infra-red (NIR) spectroscopy sensor sub-system 103; a shortwave infra-red (SWIR) spectroscopy sensor sub-system 104; a laser-induced breakdown spectroscopy (LIBS) sensor sub-system 105; a Gamma sensor sub-system 106; a magnetic susceptibility sensor sub-system 107; and a Raman sensor sub-system 108.

The XRF sensor sub-system 100 sample requirements for sample placement, including material, dimensions, assembly, and handling, are as follows:

(i) Sample to be dry with less than 1 percent by weight of moisture content and free-flowing.
(ii) Pressed to maintain relative density consistency.
(iii) Sample must remain static during the test. (Stationary multi-beam measurement.)
(iv) Minimum sample dimensions of 25 mm (diameter)× 15 mm (depth).
(v) Sample has a flat top with ±0.05 mm surface variation (peak to trough <0.1 mm).
(vi) Sample holder to be in contact with the XRF sensor sub-system module.
(vii) Sample to be loaded below the XRF (XRF optical path facing down).
(viii) Sub-system 100 has to prevent debris from spilling onto window area (prevent sample contamination).
(ix) Sub-system 100 has to prevent damage to the XRF window and equipment from falling debris or abrasion.
(x) Sub-system 100 requires protective window for tube/detector.
(xi) Use of filters and collimation (2-beam geo-chem mode).
(xii) Maximum window thickness of 4 micron in the situation where window is made from polypropylene or from Mylar/Kapton (if light elements are not necessary).
(xiii) Alternative use of gas (positive pressure) to prevent dust getting in using appropriate flow rates and chamber pressure.

Presenting the sample with a flat surface provides for consistency in the sampling distance between the XRD sensor sub-system 101 and the sample material.

In this embodiment, the XRD sensor sub-system 101 has the following preferred requirements for the sample itself and also sample placement, including material, dimensions, assembly, and handling:

(i) Sample to be dry with less than 1 percent by weight of moisture content.
(ii) Maximum size distribution less than 150 micron.
(iii) Sample volume of 100±50 cubic mm.
(iv) Sample must be fed into a chamber able to accept approximately 100 cubic mm sample.
(v) The distance between the Kapton window and the instrument must be maintained at 175 micron±0.25 mm.
(vi) The control system 57 defines (based on volume) sample timing and quality assurance/quality control (QAQC) samples.

Referring again to FIG. 1, the data collection, management and transfer sub-system 55 provides real-time transfer to cloud-based storage 110 such as, for example, the REFLEXHUB-IQ™. The sub-system 55 includes real-time delivery of data from the drilling rig (where sub-systems 51 through 55 reside) to a remote office. The sub-system 55 is able to collect field operation data, including time-stamped collection and analysis event, rate of penetration (ROP), and drilling state data, and to transfer the data to the cloud-based storage 110 (e.g. REFLEXHUB-IQ™). It is also able to collect raw XRD data and Level 1 product XRF data, which is XRF data that has undergone some initial processing on an on-site mini-server, and to transfer the data to the cloud-based storage 110 (e.g. REFLEXHUB-IQ™).

The data collection, management and transfer sub-system 55 may also feature provision 111 for on-site data storage.

The data, management and transfer sub-system 55 may aggregates analytical data with associated metadata.

As regards the automated data analysis and interpretation sub-system 56, raw data that is provided by the system 50 in real-time is processed automatically be off-site computers. This allows for much more advanced data processing capabilities than would be possible with the limited on-site computers, and allows for a more streamlined field unit. Return of the resulting products produced by the sub-system 56 to the sub-system 55 allows near real-time access to both the raw data and advanced knowledge developed through post-processing for decision support and planning during the drilling process. Advanced data processing includes, but is not limited to:

(i) Depth positioning algorithm—using drilling parameters such as time, fluid flow rate, sample weight/volume, rate of penetration (ROP), annulus area, etc. the depth interval of the sample can be determined.
(ii) Advanced XRD and XRF processing.
(iii) Combined measurement while drilling (MWD), XRF, and XRD data used to provide predictive geological products (lithologies, alteration facies, mineralization potential, geometallurgical domains, mineralogy, and physical properties as specified by system users).
(iv) Decision support; real-time data and analytics enable the system to inform the continued drilling of the hole and planning of subsequent holes.

In relation to the control and monitoring sub-system 57, it is an advanced control sub-system that allows the maintenance of sample chain of custody throughout the system 50. The sub-system 57 collects system data for diagnostics and can be accessed remotely if necessary for troubleshooting and remote in-field adjustments.

Figure 7:
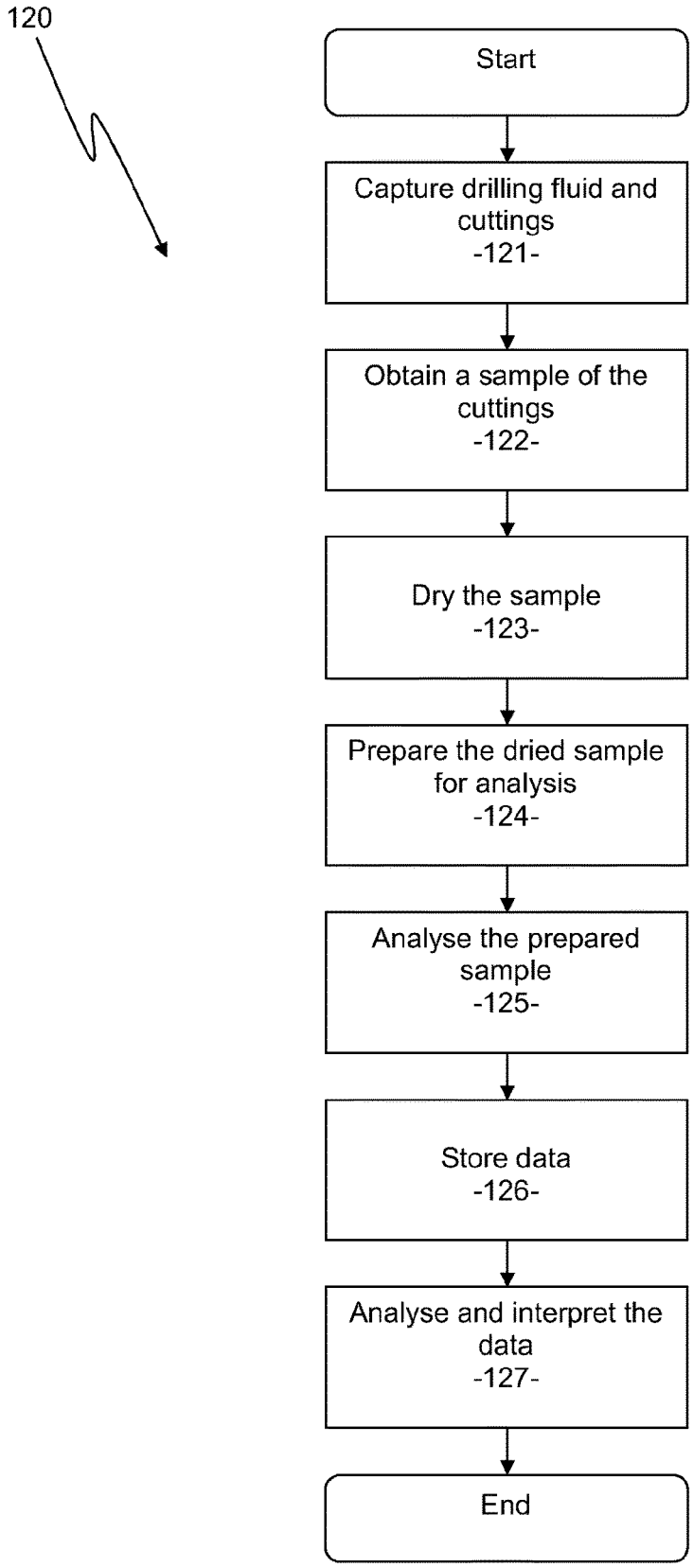
FIG. 7 is a flow chart of a preferred embodiment of an autonomous sampling and analysis method for use in exploration drilling.

Referring to FIG. 7, an autonomous sampling and analysis method 120 employed when using the system 50 includes a step 121 of capturing drilling fluid and cuttings using the capturing sub-system 51. After the drilling fluid and cuttings have been captured at step 121, a sample of the captured cuttings is obtained at step 122 using the sample recovery sub-system 52. At step 123, the sample is dried using the sample preparation sub-system 53. The dried sample is prepared for analysis at step 124 and analysed at step 125 using the sample handling and sensor sub-system 54. Data obtained by the system 50 is then stored at step 126 by the data collection and management sub-system 55, and is analysed and interpreted at step 127 by the automated data analysis and interpretation sub-system 56.

The system 50 and method 120 address the issue of delays from when a drill hole sample is obtained to when the results are made available, and allows for a rapid means to collect and access this data so that results are obtained in near real-time, and so that decisions can be made at the time of drilling.

The automated sampling and analysis system 50 is an integrated system that is able to perform real-time data collection and data analysis. It is able to perform parts per million (ppm) level chemical analysis that allows for application of the data it collects in an exploration setting. Further, it is able to perform XRF and XRD analysis. The near real-time availability of raw data and derivative products that the system 50 is able to provide from any web-accessible device allows for real-time planning and decision support as drilling is taking place. The system 50 produces more data at a faster rate and for a lower cost than conventional laboratories are able to. Another advantage of the system 50 is that it can reduce shipping costs for samples by reducing the number of samples shipped to a laboratory for analysis.

Although the system 50 is not necessarily meant to replace the use of normal laboratories for processing drilling samples, it can nevertheless be used for this role.

The system 50 is relatively complicated and therefore needs to have very good reliability for field use. However, the modular design of the system 50 should alleviate this and allow for fast repair, if necessary.

As is evident from the foregoing description, the first embodiment of the sampling and analysis system 50 according to the invention is autonomous in the sense that it is integrated and capable of performing its various functions in a fully automated fashion or at least with a high degree of autonomy. However, this need not necessarily be so. In other embodiments, the sampling and analysis system may comprise one or more separate units providing one or more of the various sub-systems involved. Further, in still other embodiments, the sampling and analysis system may be adapted to be operated manually or semi-automatically, at least in part.

Figure 8:
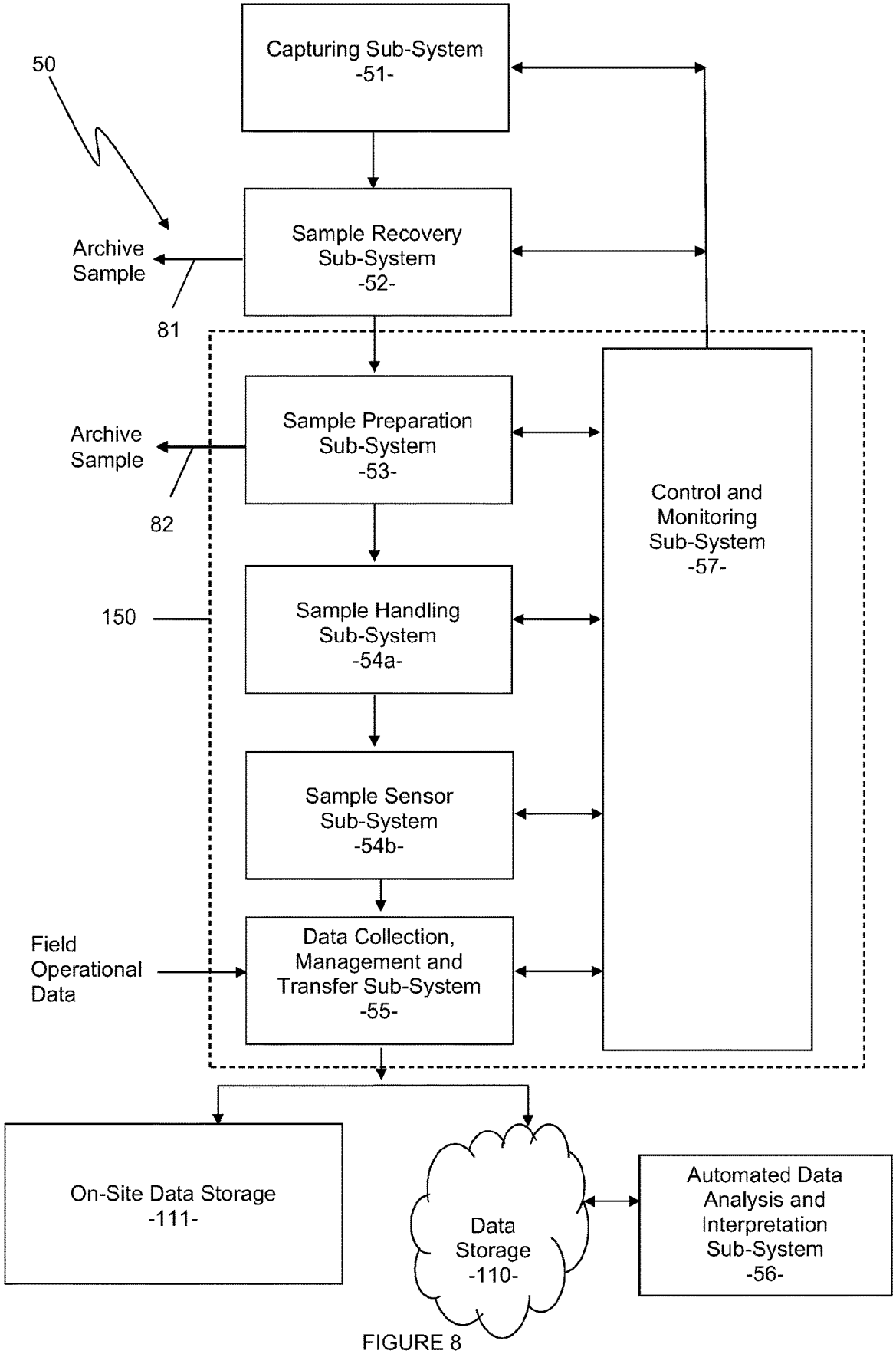
FIG. 8 is a schematic diagram of a second preferred embodiment of a sampling and analysis system for use in exploration drilling.
Figure 9:
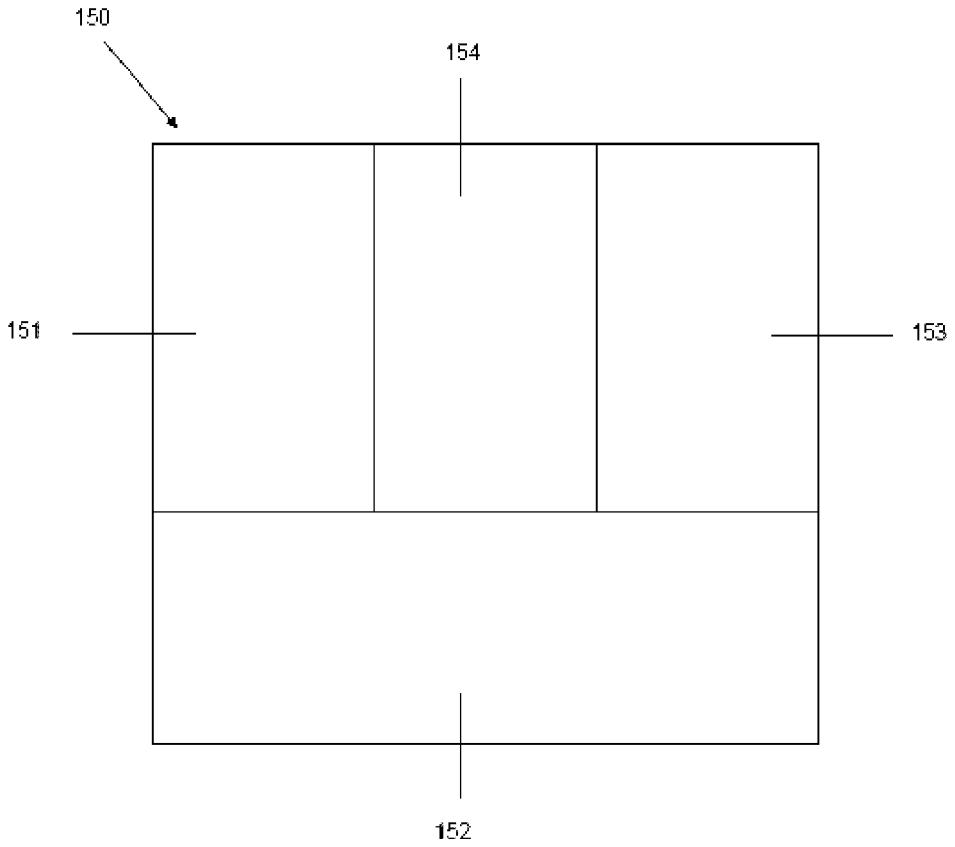
FIG. 9 is a schematic view of an onsite facility used as part of the second preferred embodiment of a sampling and analysis system.
Figure 10:
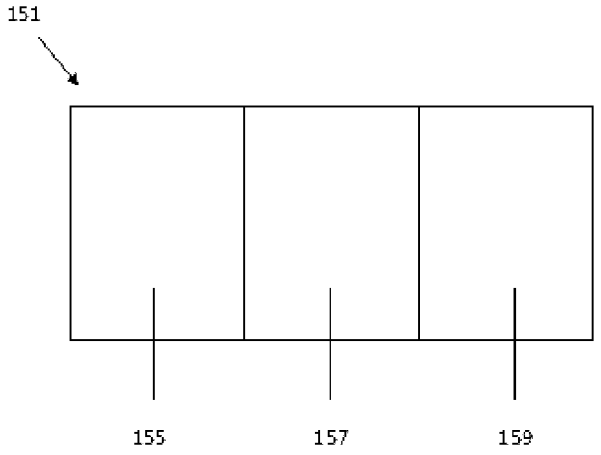
FIG. 10 is a schematic view of part of the onsite facility depicted in FIG. 9.

Referring now to FIGS. 8 to 10, there is shown a second embodiment of sampling and analysis system 50 for use in exploration drilling. The second embodiment of sampling and analysis system 50 is similar in many respects to the first embodiment and similar reference numerals are used to identify similar parts.

In this second embodiment, the sampling and analysis system 50 comprises capturing sub-system 51, sample recovery and splitting sub-system 52, sample preparation/drying sub-system 53, sample handling and sensor sub-system 54, data collection, management and transfer sub-system 55, automated data analysis and interpretation sub-system 56, and control and monitoring sub-system 57 for data collection and process control. However, rather than being an autonomous, the system 50 of this second embodiment is configured such that some aspects function automatically and other aspects are performed manually, at least in part. In particular, the functions performed by, or associated with, capturing sub-system 51, sample recovery and splitting sub-system 52, data collection, management and transfer sub-system 55, automated data analysis and interpretation sub-system 56, and control and monitoring sub-system 57 for data collection and process control, may be performed automatically as is the case with the first embodiment. However, the functions performed by, or associated with, the sample preparation/drying sub-system 53, sample handling and sensor sub-system 54 are performed with some manual involvement. Further, in this second embodiment, the sample handling and sensor sub-system 54 in fact comprises a sample handling sub-system 54*a* and a sample sensor sub-system 54*b*, each as a separate unit, as depicted in FIG. 8.

The sample preparation sub-system 53 for drying the sample and the sample handling sub-system 54*a* cooperate to provide a means for drying the sample and for preparing the dried sample such that the sample is able to be presented in manner appropriate for analysis.

In this second embodiment, the capturing sub-system 51 and the sample recovery sub-system 52 operate in the same way as the first embodiment. However, the recovered sample material is then transported to a service facility 150 deployed at or nearby to the site at which the exploration drilling is being conducted. The service facility 150 is set up for operation in the field to prepare appropriate samples for analysis, and to also conduct the analysis, as previously described. The service facility 150 is preferably transportable for movement to and from site, and also for relocation from one drilling site to another.

The service facility 150 comprises a first station 151 at which sample material recovered from the sample recovery sub-system 52 can be prepared to provide samples for analysis, a second station 152 at which the analysis can be performed, and a third station 153 at which the data collection, management and transfer sub-system 55 is accommodated, as shown schematically in FIG. 8. The service facility 150 may optionally also comprise a fourth station 154 configured for general storage.

The first station 151 may accommodate the sample preparation sub-system 53. More particularly, the first station 151 may accommodate a dryer 155 for drying the sample material. The dryer 155 may comprise the spin flash dryer 90. Other appropriate types of drying apparatus may be used as the dryer 155, including for example a drying oven.

The first station 151 may also accommodate the sample handling sub-system 54*a*. More particularly, the first station 151 may accommodate apparatus 157 for preparing the dried sample material for analysis. In this embodiment, the dried sample material is prepared as a pressed pellet, in which case the apparatus 157 may comprise a press; for example, a manually operable hydraulic press. The sample material is received by apparatus 157 from the dryer 155 in loose powder form. The sample material, in powder form, is introduced into a die and then compressed in the press to produce a homogeneous sample pellet. The pellet so formed is then taken to the second station 152 at which the sample sensor sub-system 54*b* is accommodated for the analysis to be performed. The sample sensor sub-system 54*b* at the second station 152 may, for example, comprise an X-ray fluorescence (XRF) sensor and an X-ray diffraction (XRD) sensor.

Sample pellets produced at the first station 151 may be conveyed to the second station 152 in any appropriate way. This may, for example, be by way of an operator simply carrying sample pellets from the first station 151 to the second station 152, or alternatively a transfer mechanism may be provided.

Results yielded by the sample sensor sub-system 54*b* are transmitted to the data collection, management and transfer sub-system 55 at the third station 153.

In this embodiment, sample material is retrieved manually from the sample recovery sub-system 52 and transported to the service facility 150 for preparation and analysis. It should, however, be appreciated that the sample retrieval process may be automated or at least mechanised in some way. Further, the process by which the retrieved sample material is transported to the service facility 150 may be automated or at least mechanised in some way.

In this embodiment, a drilling operation is conducted sequentially; that is, as a sequence of drilling cycles, with drilling stopping temporarily between the drilling cycles. The intervals between drilling cycles represent the conclusion of one drilling cycle and the commencement of the next drilling cycle.

Each drilling cycle leads to an increase in borehole depth. The duration of each drilling cycle, and the corresponding increase in borehole depth, can vary according to various circumstances, including the geology of the formation being drilled. A typical drilling cycle may, for example, lead to an increase in borehole depth of say about 3 to 6 metres.

Drill cuttings generated in each drilling cycle are captured continuously during the drilling cycle by the capturing sub-system 51 in a flow of drilling fluid returns as drilling progresses during the drilling cycle. The drilling fluid returns for the drilling cycle are conveyed as a continuous stream to the sample recovery sub-system 52 at which the drilling cuttings are recovered from the drilling fluid returns by the centrifuge 80. The recovered drilling cuttings are discharged from the centrifuge 80 as a continuous stream in coordinated sequence with the flow of drilling fluid returns, thereby facilitating a correlation between the recovered drilling cuttings and the depth within the borehole at which the cutting were generated and retrieved.

The stream of recovered drilling cuttings from the centrifuge 80 is collected in batches. Each batch represents a prescribed volume of captured drilling cuttings. In other words, the captured drilling cuttings are collected by volume, with each volume corresponding to the specific depth interval within the borehole.

Typically, the captured drilling cuttings (corresponding to a specific depth interval) would be delivered from centrifuge 80 as a stream of drilling cuttings which is intercepted and collected in a plurality of sample collection containers such as buckets. In this embodiment, the sample collection containers would be selectively positioned one after another in the path of the stream of drilling cuttings delivered from centrifuge 80, whereby each sample collection container can intercept the stream of drilling cuttings. Each collected portion or segment of the stream of drilling cuttings thus represents one sample batch.

The sample collection containers may be selectively positioned one after another in the path of the stream of drilling cuttings in any appropriate way. By way of example, the sample collection containers may be positioned on a conveyor or carousel adapted to advance the sample collection containers sequentially into and out of the path of the stream of recovered drilling cuttings from the centrifuge 80.

The total volume of the various sample collection containers is selected to accommodate drilling cuttings derived from one drilling cycle. By way of example, a drilling cycle may represent an increase in borehole depth of say 3 m, and say three sample collection containers may be used to collect the drilling cuttings derived from that drilling cycle. The various sample collection containers used to collect the drilling cuttings derived from that drilling cycle would have a total volume sufficient to accommodate drilling cuttings generated. In this way, the batch of drilling cuttings collected in the sample containers would be representative of the specific depth interval within the borehole to which the recovered drilling cuttings within the batch relate. In other words, each batch of drilling cuttings collected in the sample containers would reflect the strata of the underground location to which that batch was related.

In circumstances where drilling is conducted sequentially (that is, as a sequence of drilling cycles), with drilling ceasing temporarily between the drilling cycles, it may be that drilling cuttings generated in one drilling cycle might not necessarily all be collected in that same drilling cycle. Owing to the time required for drilling fluid returns to be transported to the sample recovery subsystem (centrifuge 80) and for the drilling cuttings in the drilling fluid returns to be separated and discharged from the sample recovery subsystem, it may be that at least some of the drilling fluid cuttings are actually collected during a subsequent drilling cycle. This delay can, however, be accounted for as a consequence of the sample recovery subsystem providing a stream of recovered drilling cuttings in coordinated sequence with the flow of drilling fluid return. Accordingly, the correlation between the recovered drilling cuttings and the depth within the borehole at which the cutting were generated and retrieved can still be made. The sequence of drilling cuttings is not significantly affected by the intermittent nature of the process due partially to the generally thixotropic characteristics of the drilling fluid.

Each batch may be marked for identification purposes in any appropriate way, such as by way of a bar code, for maintenance of a chain of custody in respect to the sampling operation.

A sub-sample of each sample lot of drilling cuttings in the sample container can then be collected and taken to the service facility 150 for preparation and analysis. Typically, the sub-sample would be extracted from the batch as a vertical column within the batch, thereby continuing to reflect the strata of the underground location to which the batch was related. A sampling spear may be used to extract the sub-sample as a vertical column within the batch. A sub-sample of the recovered drilling cuttings material extracted from the batch would then be representative of the specific depth interval within the borehole to which the particular recovered drilling cuttings related. In this way, the sub-sample provides a representative sample for preparation and analysis.

The representative sample taken to the service facility 150 for preparation and analysis may also marked for identification purposes in any appropriate way, such as by way of a bar code, for maintenance of a chain of custody in respect to the sampling operation.

Still further, the pressed pellet produced at the first station 151 may also be marked for identification purposes, such as by way of a bar code affixed to or embedded in the pellet, for maintenance of a chain of custody in respect to the sampling operation.

The sampling and analysis system according to the invention may provide for the collection of high quality, low-level (ppm) multi-element geochemical data, and quantitative minerology as typically required for exploration drilling.

It has been found that with the sampling and analysis system according to the invention there is a good correlation between the findings of analysis of samples derived from drilling cutting for a particular downhole location to findings of analysis of a core sample extracted from that same downhole location.

It is a feature of present invention when applied to diamond drilling, that drilling cuttings can be used as a source material for sampling and analysis. This is particularly so with the present embodiments, in which the sample recovery sub-system 52 comprises part of a solids control system of the type disclosed in Australian Patent Applications 2012318265 and 2013204746. With such an arrangement, there is recognition that the solids control system allows the recovered drilling cuttings to provide viable sample material. Previously, such drilling cuttings were considered as waste.

The present invention has been described in terms of preferred embodiments in order to facilitate better understanding of the invention, it should be appreciated that various modifications can be made without departing from the principles of the invention. Therefore, the invention should be understood to include all such modifications within its scope.

For instance, the system 50 may be used to collect materials from other fields of endeavour, and also from other drilling technologies, such as reverse circulation (RC) drilling technologies.

This disclosure is intended to explain how to fashion and use various embodiments in accordance with the technology rather than to limit the true, intended, and fair scope and spirit thereof. The foregoing description is not intended to be exhaustive or to be limited to the precise forms disclosed. Modifications or variations are possible in light of the above teachings. The embodiment was chosen and described to provide the best illustration of the principle of the described technology and its practical application, and to enable one of ordinary skill in the art to utilise the technology in various embodiments and with various modifications as are suited to the particular use contemplated.

Reference to positional descriptions, such as "upper", "lower", "top", and "bottom", "front", "rear" and "side" are to be taken in context of the embodiments depicted in the drawings, and are not to be taken as limiting the invention to the literal interpretation of the term but rather as would be understood by the skilled addressee.

Additionally, where the terms "system", "device" and "apparatus" are used in the context of the invention, they are to be understood as including reference to any group of functionally related or interacting, interrelated, interdependent or associated components or elements that may be located in proximity to, separate from, integrated with, or discrete from, each other.

Throughout the specification and claims, unless the context requires otherwise, the word "comprise" or variations such as "comprises" or "comprising", will be understood to imply the inclusion of a stated integer or group of integers but not the exclusion of any other integer or group of integers.

The invention claimed is:

1. A sampling and analysis system for use in exploration drilling, the system comprising:

a capturing sub-system comprising a collar capture sub-system for continuously capturing returning drilling fluid and cuttings cycled through a drill string off a drill hole while the hole is being drilled, a sample recovery sub-system for obtaining a sample of the cuttings from the captured cuttings, the sample recovery sub-system comprising a centrifuge for separating captured drilling fluid and cuttings from each other to make a sample available at a reduced moisture content amenable to rapid drying, a sample preparation sub-system for drying and deagglomerating the sample, the sample preparation sub-system comprising a spin flash dryer configured to maintain the sample at a temperature of less than about 105° C. to dry the sample to less than about 1% by weight of water ($H_2O$) in less than 5 minutes to prevent mineralogical damage to the sample, a sample handling sub-system for preparing the dried sample, the sample handling sub-system comprising a press for presenting the dried sample with a flat surface to provide a homogenous representation of the sample for analysis, and a sensor sub-system for analyzing the presented sample, the sensor sub-system comprising at least one sensor selected from a group consisting of an X-ray fluorescence (XRF) analysis sensor, an X-ray diffraction (XRD) analysis sensor, an infra-red (IR) spectroscopy analysis sensor, a near infra-red (NIR) spectroscopy analysis sensor, a shortwave infra-red (SWIR) spectroscopy analysis sensor, a laser-induced breakdown spectroscopy (LIBS) analysis sensor, a Gamma logging analysis sensor, a magnetic analysis sensor, and a Raman spectroscopy analysis sensor.

2. The system defined by claim 1, wherein the sample preparation sub-system further comprises a buffer for holding the sample.

3. The system defined by claim 1, wherein the sample preparation sub-system is adapted such that the dried sample is able to be delivered to a discharge outlet for subsequent delivery to the sample handling sub-system with less than about 1% mass loss.

4. The system defined by claim 1, further comprising a data collection and management sub-system for collecting and managing field operation data and data obtained from the sensor sub-systems of the sample handling and sensor sub-system.

5. The system defined by claim 4, wherein the field operation data is time-stamped.

6. The system defined by claim 4, wherein the data collection and management sub-system transfers the data to cloud-based data storage.

7. The system defined by claim 4, wherein the sampling and analysis system further comprises an automated data analysis and interpretation sub-system for processing data from the data collection and management sub-system.

8. The system defined by claim 7, wherein the automated data analysis and interpretation sub-system is able to process at least some of the data using a depth positioning algorithm.

9. The system defined by claim 7, wherein the automated data analysis and interpretation sub-system is able to provide decision support in relation to the continued drilling of the hole and the planning of subsequent holes.

10. A sampling and analysis method performed using a sampling and analysis system according to claim 1.

11. An autonomous sampling and analysis method for use in exploration drilling, the method comprising the steps of:

continuously capturing returning drilling fluid and cuttings with a collar capture sub-system, the drilling fluid and cuttings cycled through a drill string off a drill hole while the hole is being drilled;

obtaining a sample of the cuttings from the captured cuttings, the sample obtained using a centrifuge for separating captured drilling fluid and cuttings from each other to make a sample available at a reduced moisture content amenable to rapid drying;

drying and agglomerating the sample using a spin flash dryer configured to maintain the sample at a temperature of less than 105° C. to dry the sample less than about 1% by weight of water ($H_2O$) in less than 5 minutes to prevent mineralogical damage to the sample;

preparing the dried sample using a press for presenting the dried sample with a flat surface to provide a homogenous representation of the sample for analysis; and analyzing the presented sample using a sensor selected from the group consisting of an X-ray fluorescence (XRF) analysis sensor, an X-ray diffraction (XRD) analysis sensor, an infra-red (IR) spectroscopy analysis sensor, a near infra-red (NIR) spectroscopy analysis sensor, a shortwave infra-red (SWIR) spectroscopy analysis sensor, a laser-induced breakdown spectroscopy (LIBS) analysis sensor, a Gamma logging analysis sensor, a magnetic analysis sensor, and a Raman spectroscopy analysis sensor.

12. The method defined by claim 11, further comprising the step of collecting and managing field operation data and data obtained from analyzing the prepared sample.

13. The method defined by claim 12, wherein the field operation data is time-stamped.

14. The method defined by claim 12, wherein the step of collecting and managing field operation data and data obtained from analyzing the prepared sample comprises transferring the data to cloud-based data storage.

15. The method defined by claim 11, wherein the sampling and analysis method further comprises the step of processing the data, and wherein the step of processing the data comprises processing at least some of the data using a depth positioning algorithm.

16. The method defined by claim 15, wherein the step of processing the data comprises providing decision support in relation to the continued drilling of the hole and the planning of subsequent holes.

* * * * *